US010483635B2

(12) United States Patent
Yu et al.

(10) Patent No.: US 10,483,635 B2
(45) Date of Patent: Nov. 19, 2019

(54) MULTI-FREQUENCY COMMUNICATIONS ANTENNA AND BASE STATION

(71) Applicant: HUAWEI TECHNOLOGIES CO., LTD., Shenzhen, Guangdong (CN)

(72) Inventors: Yanmin Yu, Shenzhen (CN); Jian Song, Shenzhen (CN); Dingjiu Daojian, Munich (DE); Peng Liu, Xi'an (CN)

(73) Assignee: HUAWEI TECHNOLOGIES CO., LTD., Shenzhen, Guangdong (CN)

( * ) Notice: Subject to any disclaimer, the term of this patent is extended or adjusted under 35 U.S.C. 154(b) by 0 days.

(21) Appl. No.: 15/993,587

(22) Filed: May 30, 2018

(65) Prior Publication Data

US 2018/0351246 A1 Dec. 6, 2018

Related U.S. Application Data

(63) Continuation of application No. PCT/CN2015/096239, filed on Dec. 3, 2015.

(51) Int. Cl.
*H01Q 1/52* (2006.01)
*H01Q 21/00* (2006.01)
(Continued)

(52) U.S. Cl.
CPC ..... *H01Q 1/521* (2013.01); *H01Q 1/246* (2013.01); *H01Q 5/328* (2015.01); *H01Q 5/48* (2015.01);
(Continued)

(58) Field of Classification Search
CPC ..... H01Q 1/52; H01Q 1/521; H01Q 1/246; H01Q 5/328; H01Q 5/48; H01Q 15/14;
(Continued)

(56) References Cited

U.S. PATENT DOCUMENTS 6,222,488 B1 4/2001 Pai-Chuan et al.
6,323,820 B1 11/2001 Haunberger
(Continued)

FOREIGN PATENT DOCUMENTS

CN 1913226 A 2/2007
CN 102868017 A 1/2013
(Continued)

*Primary Examiner* — Hoang V Nguyen
(74) *Attorney, Agent, or Firm* — Womble Bond Dickinson (US) LLP

(57) ABSTRACT

Embodiments of the present invention provide a multi-frequency communications antenna and a base station. The multi-frequency communications antenna includes at least one low-frequency array, at least one high-frequency array, at least one circuit board disposed corresponding to the high-frequency array, and a reflection panel, where a filtering component configured to decouple filtering is disposed on the circuit board, a first end of the filtering component is electrically connected to the high-frequency array, and a second end of the filtering component is electrically connected to a signal ground layer of the circuit board. The filtering component configured to decouple filtering that is shown in this embodiment is disposed on the circuit board, which causes a small damage to an array radiation environment.

18 Claims, 7 Drawing Sheets

(51) Int. Cl.

| | |
|---|---|
| ***H01Q 5/328*** | (2015.01) |
| ***H01Q 1/24*** | (2006.01) |
| ***H01Q 21/26*** | (2006.01) |
| ***H01Q 21/29*** | (2006.01) |
| ***H01Q 21/30*** | (2006.01) |
| ***H01Q 15/14*** | (2006.01) |
| ***H01Q 21/28*** | (2006.01) |
| ***H01Q 5/48*** | (2015.01) |

(52) U.S. Cl.
CPC ..... *H01Q 15/14* (2013.01); *H01Q 21/0031* (2013.01); *H01Q 21/26* (2013.01); *H01Q 21/28* (2013.01); *H01Q 21/293* (2013.01); *H01Q 21/30* (2013.01)

(58) Field of Classification Search
CPC .... H01Q 21/0031; H01Q 21/26; H01Q 21/28; H01Q 21/293; H01Q 21/30
See application file for complete search history.

(56) References Cited

U.S. PATENT DOCUMENTS

2003/0232600 A1 12/2003 Montgomery et al.
2005/0253769 A1* 11/2005 Timofeev ..... H01Q 1/246 343/797
2009/0135078 A1 5/2009 Lindmark et al.
2010/0285836 A1 11/2010 Horihata et al.
2011/0043425 A1* 2/2011 Timofeev ..... H01Q 1/246 343/817
2011/0175782 A1* 7/2011 Choi ..... H01Q 1/246 343/798
2014/0242930 A1* 8/2014 Barker ..... H01Q 1/246 455/129
2015/0263435 A1* 9/2015 Song ..... H01Q 21/062 343/810
2015/0295313 A1* 10/2015 Zimmerman ..... H01Q 5/48 343/810
2016/0172757 A1 6/2016 Gottl et al.
2016/0322696 A1 11/2016 Bu et al.
2016/0329642 A1 11/2016 Chainon et al.

FOREIGN PATENT DOCUMENTS

CN 103682561 A 3/2014
CN 103730728 A 4/2014
CN 103779658 A 5/2014
CN 104037497 A 9/2014
CN 104064867 A 9/2014
CN 104600439 A 5/2015
CN 204596981 U 8/2015
CN 104900987 A 9/2015
DE 102013012305 A1 1/2015

* cited by examiner

MULTI-FREQUENCY COMMUNICATIONS ANTENNA AND BASE STATION

CROSS-REFERENCE TO RELATED APPLICATIONS

This application is a continuation of International Application No. PCT/CN2015/096239, filed on Dec. 3, 2015, the disclosure of which is hereby incorporated by reference in its entirety.

TECHNICAL FIELD

The present invention relates to an antenna, and in particular, to a multi-frequency communications antenna and a base station.

BACKGROUND

With popularization of smartphones, and continuous increase in demands of users on high-speed data services, modern mobile communications develop in a multi-frequency and multi-mode direction. However, because it becomes increasingly difficult to acquire resources at an available site and the site raises a higher requirement for integration with an ambient environment, a multi-frequency communications antenna of higher integration becomes a future development direction of a base station antenna.

A multi-frequency communications antenna refers to an antenna that includes multiple antenna arrays that can operate on different frequency bands. Arrangement of multiple antenna arrays that have different frequency bands in limited installation space often results in a significant decrease in electrical performance of each array, such as a horizontal beam width, a cross polarization level, and a front-to-rear ratio, due to relatively strong electromagnetic coupling.

To ensure that the multi-frequency communications antenna still has a good radiation characteristic in a case of high integration, for example, a low-frequency radiation apparatus disclosed in Chinese Patent Application No. 201210319758.21 in the prior art includes a first low-frequency radiation module and a second low-frequency radiation module, where an open-circuit stub for suppressing transmission of a high-frequency electromagnetic wave in the low-frequency radiation apparatus is disposed separately at a side of an axial center of the first low-frequency radiation module and the second low-frequency radiation module, and a coupled current of another frequency is suppressed using the open-circuit stub.

However, disadvantages of the low-frequency radiation apparatus shown in the prior art lie in that: 1. The open-circuit stub is implemented only on a balun by means of sheet-metal working or PCB processing, and is difficult to be implemented by means of die-casting. 2. Even if multiple open-circuit stubs with different lengths are used, a relatively narrow bandwidth can be suppressed. 3. Elimination of a mutual coupling effect is only related to a structural length of the designed open-circuit stub, and multi-frequency mutual coupling and wideband mutual coupling cannot be resolved. 4. A structure of the open-circuit stub that eliminates mutual coupling damages an operating environment of the low-frequency radiation apparatus.

SUMMARY

The present invention provides a multi-frequency communications antenna and a base station, so as to effectively suppress inter-frequency mutual coupling generated in the multi-frequency communications antenna.

A first aspect of embodiments of the present invention provides a multi-frequency communications antenna, including at least one low-frequency array, at least one high-frequency array, and at least one circuit board disposed corresponding to the high-frequency array, where the circuit board is configured to feed power to the high-frequency array; and a reflection panel configured to fasten the low-frequency array and the high-frequency array, where a side surface of the circuit board opposite to the reflection panel includes a signal ground layer, and the signal ground layer of the circuit board is coupled to the reflection panel; and a filtering component to decouple filtering is disposed on the circuit board, where a first end of the filtering component is electrically connected to the high-frequency array, and a second end of the filtering component is electrically connected to the signal ground layer of the circuit board.

The filtering component configured to decouple filtering is disposed on the circuit board, and there is no need to dispose, on the low-frequency array and the high-frequency array, a component configured to perform filtering. Therefore, the multi-frequency communications antenna provided in the embodiments of the present invention causes a small damage to an array radiation environment, and does not damage an operating environment of the low-frequency array and the high-frequency array.

A 10-dB suppressing band of the high-frequency array ranges from 660 MHz to 760 MHz after the filtering component is added, covering an entire receive/transmit frequency band of 700 M, and having a good broadband suppression characteristic.

In one embodiment, the high-frequency array includes a radiating element and a power feeding balun, where a first end of the power feeding balun is electrically connected to the radiating element, and a second end of the power feeding balun is electrically connected to the signal ground layer of the circuit board, and the second end of the power feeding balun is further electrically connected to the first end of the filtering component.

In one embodiment, at least one first ground point and at least one second ground point are disposed at the second end of the power feeding balun; and the first ground point and the second ground point are disposed passing through the circuit board, and the first ground point and the second ground point are soldered to the side surface of the circuit board opposite to the reflection panel, where the first ground point is electrically connected to the signal ground layer of the circuit board, and the second ground point is electrically connected to the first end of the filtering component.

In one embodiment, the filtering component includes a first sub-component disposed on a signal line layer of the circuit board, and a second sub-component disposed on the signal ground layer of the circuit board, where the first sub-component is electrically connected to the signal ground layer of the circuit board, and the second sub-component is electrically connected to the radiating element.

In one embodiment, a first metalized through hole and a second metalized through hole are disposed passing through the circuit board, and a distance between the first metalized through hole and the power feeding balun is less than a distance between the second metalized through hole and the power feeding balun; and a first end of the second sub-component is electrically connected to the second ground point of the power feeding balun, a second end of the second sub-component is electrically connected to a first end of the first sub-component using the first metalized through hole, and a second end of the first sub-component is electrically connected to the signal ground layer using the second metalized through hole.

In one embodiment, the signal ground layer of the circuit board (includes at least one metal layer.

In one embodiment, the signal ground layer of the circuit board includes a first metal layer and a second metal layer that are mutually insulated; and the high-frequency array is electrically connected to the first metal layer, and the second end of the filtering component is electrically connected to the second metal layer.

In one embodiment, a structure of the first sub-component can be any one of the following: an equal-width strip, an unequal-width strip, an interdigital-coupling line, a ground coupling line, a compact microstrip resonant cell or a mushroom-shaped grounding coupled diaphragm.

In one embodiment, a ratio of a center frequency of the high-frequency array to a center frequency of the low-frequency array is greater than or equal to 1.5 and less than or equal to 4.

A second aspect of the embodiments of the present invention provides a base station, including the multi-frequency communications antenna according to any one of the the embodiments of the present invention.

The embodiments of the present invention provide a multi-frequency communications antenna and a base station. The multi-frequency communications antenna includes at least one low-frequency array, at least one high-frequency array, at least one circuit board disposed corresponding to the high-frequency array, and a reflection panel, where a filtering component 108 configured to decouple filtering is disposed on the circuit board, a first end of the filtering component is electrically connected to the high-frequency array, and a second end of the filtering component is electrically connected to a signal ground layer of the circuit board. The filtering component configured to decouple filtering that is shown in this embodiment is disposed on the circuit board, which causes a small damage to an array radiation environment, so that the multi-frequency communications antenna has a good broadband suppression characteristic, and effectively suppresses multi-frequency mutual coupling and wideband mutual coupling.

DESCRIPTION OF EMBODIMENTS

The following discusses manufacturing and use of embodiments of this application in detail. However, it should be understood that the present invention provides a plenty of feasible innovative concepts that can be implemented on various specific backgrounds. A discussed specific embodiment is only to describe a specific manner of manufacturing and use of the present invention, but is not to limit the scope of the present invention.

First, a multi-frequency communications antenna is described in detail:

The multi-frequency communications antenna provided in the present invention generally refers to that an antenna includes two or more independent antenna arrays that have different operating frequencies.

In an embodiment of the present invention, the multi-frequency communications antenna includes a low-frequency array and a high-frequency array.

When the low-frequency array and the high-frequency array satisfy preset conditions, inter-frequency mutual coupling is easily generated inside the multi-frequency communications antenna.

The preset conditions are that a ratio of a center frequency of the high-frequency array to a center frequency of the low-frequency array is greater than or equal to 1.5 and less than or equal to 4, the high-frequency array and the low-frequency array are arranged horizontally, and a distance between the high-frequency array and the low-frequency array that are neighboring is short.

The preset conditions are used as an example in this embodiment of the present invention for description, and are not limited therein, as long as the inter-frequency mutual coupling is generated inside the multi-frequency communications antenna.

Figure 1:
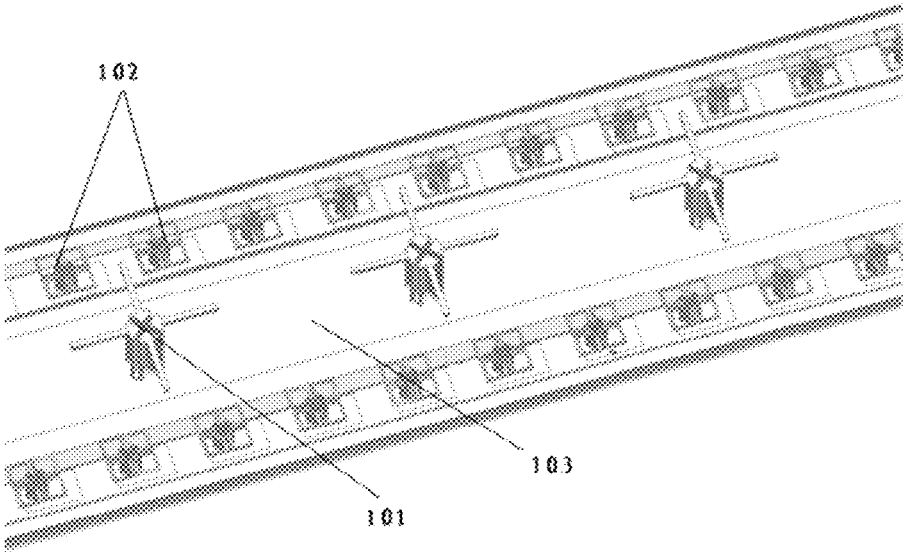
FIG. 1 is a schematic structural diagram of a multi-frequency communications antenna according to an embodiment of the present invention.

A specific arrangement manner of the multi-frequency communications antenna provided in this embodiment of the present invention is exemplified in FIG. 1. It should be noted that a structure of the multi-frequency communications antenna shown in FIG. 1 is only an example, and is not limited therein, as long as the low-frequency array and the high-frequency array satisfy the preset conditions.

The low-frequency array 101 shown in FIG. 1 operates between 698 MHz and 960 MHz, the high-frequency array 102 operates between 1710 MHz and 2690 MHz, and a ratio of a center frequency of the high-frequency array 102 to a center frequency of the low-frequency array 101 is 2.65.

As shown in FIG. 1, it can be known that, the multi-frequency communications antenna includes at least one low-frequency array 101, at least one high-frequency array 102, and one reflection panel 103 configured to fasten the low-frequency array 101 and the high-frequency array 102.

The following describes in detail how the inter-frequency mutual coupling is generated inside the multi-frequency communications antenna with reference to FIG. 1:

A main process in which the inter-frequency mutual coupling of the multi-frequency communications antenna is generated is as follows:

When the low-frequency array 101 operates, an electromagnetic wave radiated by the low-frequency array 101 spreads in a direction away from the reflection panel 103, and another electromagnetic wave radiated by the low-frequency array 101 spreads in a direction toward the reflection panel 103.

The electromagnetic wave that spreads in the direction toward the reflection panel 103 is combined with, after being reflected by the reflection panel 103, the electromagnetic wave that is radiated by the low-frequency array 101 and that spreads in the direction away from the reflection panel 103, and a combined electromagnetic wave radiates outward.

The electromagnetic wave that spreads in the direction toward the reflection panel 103 induces a corresponding induced current on the reflection panel 103.

The induced current induced on the reflection panel 103 by the low-frequency array 101 flows into the high-frequency array 102 and radiates, and therefore, the radiation of the low-frequency array 101 is interfered.

The multi-frequency communications antenna provided in this embodiment of the present invention can effectively suppress interference to radiation of the low-frequency array 101. A specific structure of the multi-frequency communications antenna provided in this embodiment of the present invention is first further described in detail with reference to FIG. 2 to FIG. 4:

The multi-frequency communications antenna further includes at least one circuit board 104, where the circuit board 104 is disposed corresponding to the high-frequency array 102, that is, at least one circuit board 104 is disposed corresponding to one high-frequency array 102.

In one embodiment, circuit board 104 may be disposed corresponding to each high-frequency array 102, or multiple neighboring high-frequency arrays 102 share circuit board 104.

In one embodiment, the circuit board 104 disposed corresponding to the high-frequency array 102 is configured to feed power to the high-frequency array 102.

Figure 4:
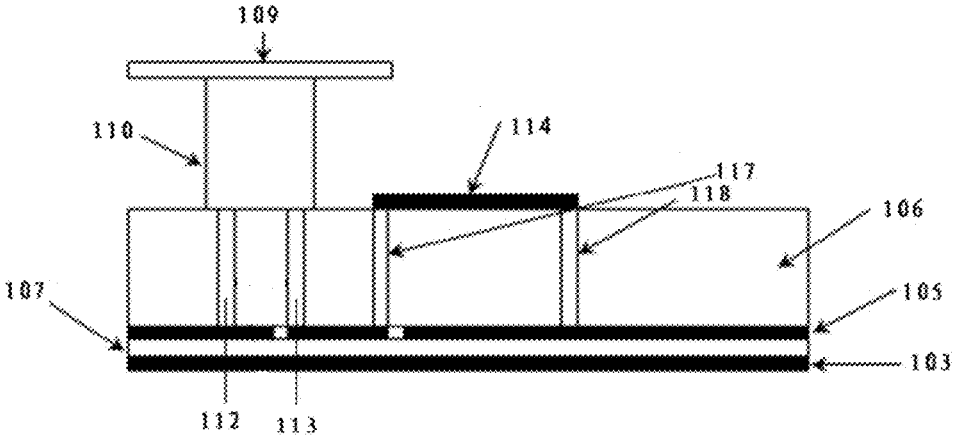
FIG. 4 is a partial schematic structural side view of a multi-frequency communications antenna according to an embodiment of the present invention.

The following describes a structure of the circuit board 104 with reference to FIG. 4.

A side surface of the circuit board 104 opposite to the reflection panel 103 includes a signal ground layer 105, and the signal ground layer 105 of the circuit board 104 is in connection with the reflection panel 103.

In one embodiment, the signal ground layer 105 includes a metal layer overlaid on the side surface of the circuit board 104 opposite to the reflection panel 103, and a material of which a dielectric layer 106 of the circuit board 104 is made of AD300.

In one embodiment, a coupling layer 107 is disposed between the circuit board 104 and the reflection panel 103.

As shown in FIG. 4, the coupling layer 107 is located between the reflection panel 103 and the signal ground layer 105.

The coupling layer 107 includes two parts: green oil coated on the signal ground layer 105 and a non-conductive dielectric sheet disposed between the signal ground layer 105 and the reflection panel 103, and a total thickness of the two may be approximately 0.25 mm.

It should be noted that instead of limiting, the thickness of the coupling layer 107 in this embodiment is described to be optional.

It can be seen that, coupled connection between the signal ground layer 105 and the reflection panel 103 is implemented using the coupling layer 107.

It should be noted that instead of limiting, this embodiment describes the coupling layer 107 as an optional example, as long as the coupling layer 107 can implement the coupled connection between the signal ground layer 105 and the reflection panel 103.

Figure 2:
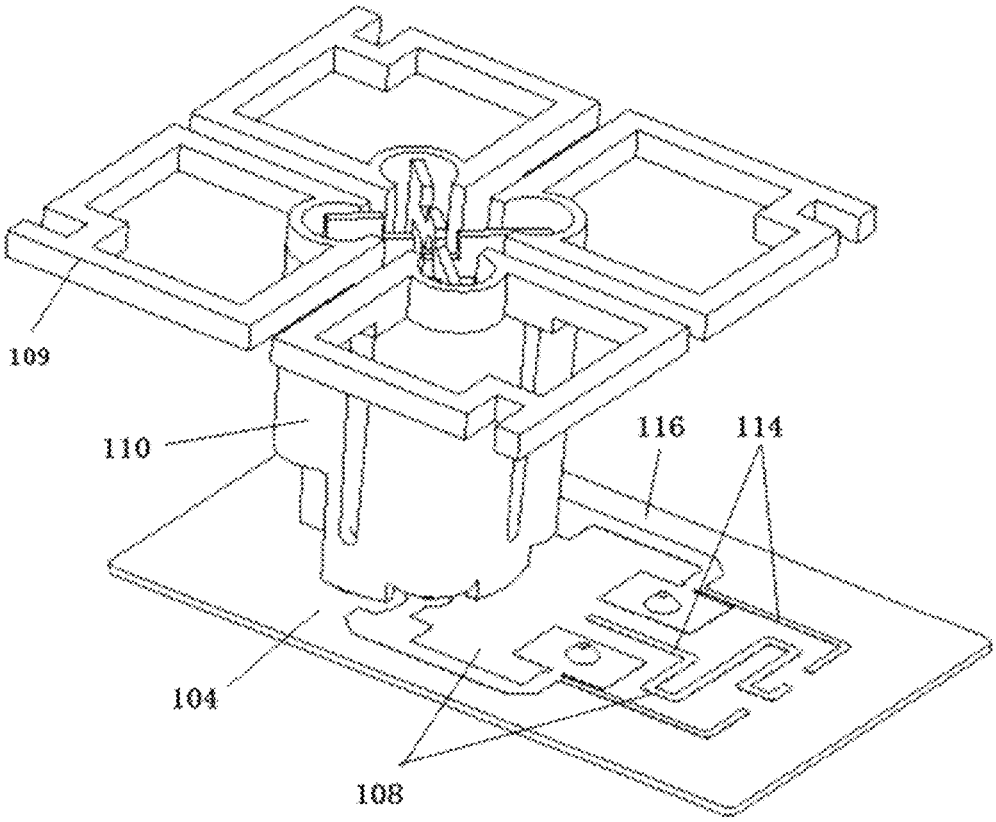
FIG. 2 is a partial schematic structural top view of a multi-frequency communications antenna according to an embodiment of the present invention.

To suppress the interference to the radiation of the low-frequency array 101, as shown in FIG. 2, a filtering component 108 configured to decouple filtering is disposed on the circuit board 104.

A first end of the filtering component 108 is electrically connected to the high-frequency array 102, and a second end of the filtering component is electrically connected to the signal ground layer 105 of the circuit board 104.

Figure 5:
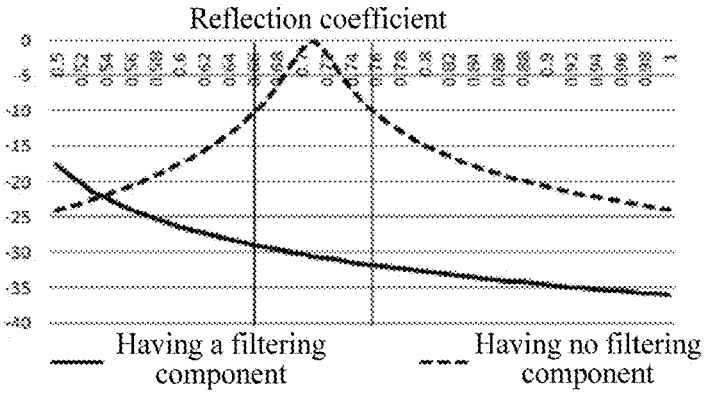
FIG. 5 is a schematic diagram of a reflection coefficient of a multi-frequency communications antenna according to an embodiment of the present invention.

It can be seen that, the filtering component 108 configured to decouple filtering as shown in this embodiment is disposed on the circuit board 104, and there is no need to dispose, on the low-frequency array (101) and the high-frequency array (102), a component configured to perform filtering. Therefore, the multi-frequency communications antenna provided in this embodiment of the present invention causes a small damage to an array radiation environment, and does not damage an operating environment of the low-frequency array 101 and the high-frequency array 102. With reference to FIG. 5, it can be known that, FIG. 5 shows a comparison between reflection coefficients before and after the filtering component 108 is added to the multi-frequency communications antenna provided in this embodiment of the present invention. It can be seen from FIG. 5 that, a 10-dB suppressing band of the high-frequency array 102 ranges from 660 MHz to 760 MHz after the filtering component 108 is added, covering an entire receive/transmit frequency band of 700 M, and having a good broadband suppression characteristic.

The following describes the specific structure of the multi-frequency communications antenna provided in this embodiment of the present invention in detail with reference to the accompanying drawings.

Figure 3:
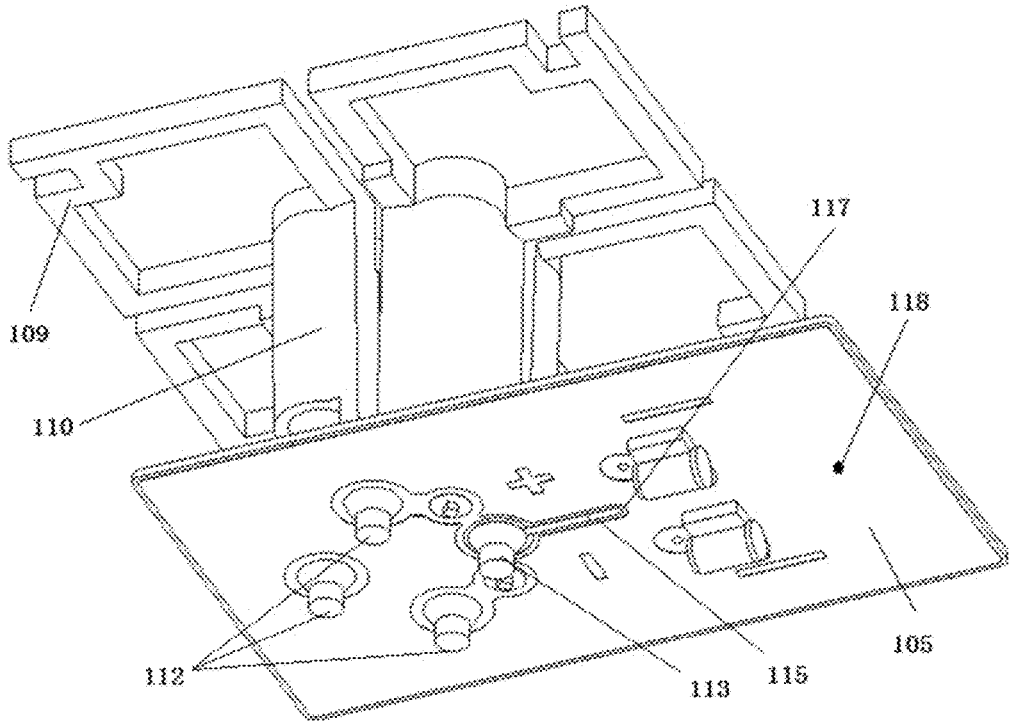
FIG. 3 is a partial schematic structural bottom view of a multi-frequency communications antenna according to an embodiment of the present invention.

In one embodiment, as shown in FIG. 2 to FIG. 4, the high-frequency array 102 includes a radiating element 109 and a power feeding balun 110.

A first end of the power feeding balun 110 is electrically connected to the radiating element 109, and a second end of the power feeding balun 110 is electrically connected to the signal ground layer 105 of the circuit board 104.

The second end of the power feeding balun 110 is further electrically connected to the first end of the filtering component 108.

Figure 6:
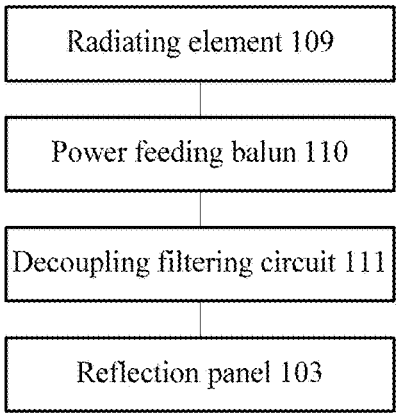
FIG. 6 is a schematic structural diagram of an embodiment of a circuit configured to decouple filtering of a multi-frequency communications antenna according to an embodiment of the present invention.

The following describes a principle on which the filtering component 108 can decouple filtering:

First, referring to FIG. 6, FIG. 6 is a schematic diagram of a circuit configured to decouple filtering of the multi-frequency communications antenna provided in this embodiment of the present invention.

As shown in FIG. 6, the reflection panel 103, a decoupling filtering circuit 111, the power feeding balun 110, and the radiating element 109 are connected in series sequentially.

The induced current on the reflection panel 103 that may radiate again is suppressed by the decoupling filtering circuit 111 that has a filtering characteristic while the induced current is transmitted to the radiating element 109, so as to ensure a stability of a directional diagram of the low-frequency array 101.

Figure 7:
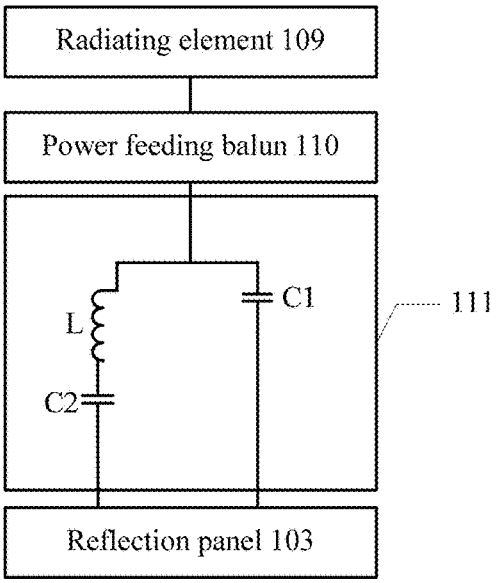
FIG. 7 is a schematic structural diagram of another embodiment of a circuit configured to decouple filtering of a multi-frequency communications antenna according to an embodiment of the present invention.
Figure 8:
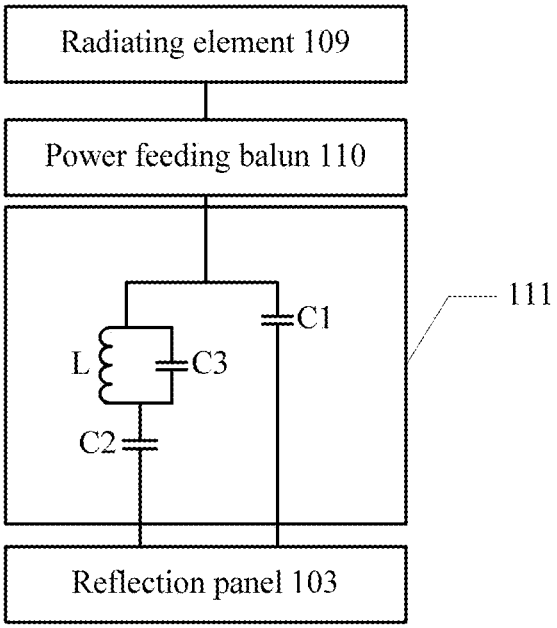
FIG. 8 is a schematic structural diagram of another embodiment of a circuit configured to decouple filtering of a multi-frequency communications antenna according to an embodiment of the present invention.

In this embodiment, the following describes a specific structure of the decoupling filtering circuit 111 with reference to FIG. 7 and FIG. 8.

An equivalent capacitance C1 in the decoupling filtering circuit 111 shown in FIG. 7 and FIG. 8 is implemented using a radio-frequency coupled connection between the signal ground layer 105 of the circuit board 104 and the reflection panel 103.

An equivalent capacitance C2 and an equivalent inductance L in the decoupling filtering circuit 111 shown in FIG. 7, and a combination of the equivalent capacitance C2, the equivalent inductance L, and an equivalent capacitance C3 in the decoupling filtering circuit 111 shown in FIG. 8 are implemented by means of the filtering component 108 disposed on the circuit board 104.

In one embodiment, the filtering component 108 is implemented by a combination of strips of different lengths and widths disposed on the circuit board 104.

The decoupling filtering circuit 111 provided in this embodiment can effectively suppress the interference to radiation of the low-frequency array 101.

The following describes how the power feeding balun 110 is electrically connected to the signal ground layer 105 and the filtering component 108 with reference to the accompanying drawings.

First, as shown in FIG. 3, at least one first ground point 112 and at least one second ground point 113 are disposed at the second end of the power feeding balun 110.

In one embodiment, multiple through holes are disposed passing through the circuit board 104, so that the first ground point 112 and the second ground point 113 can be disposed passing through the circuit board 104.

In a particular embodiment, the first ground point 112 and the second ground point 113 are soldered to the side surface of the circuit board 104 opposite to the reflection panel 103.

The first ground point 112 is electrically connected to the signal ground layer 105 of the circuit board 104, and the second ground point 113 is electrically connected to the first end of the filtering component 108.

The following describes a specific structure of the filtering component 108 provided in this embodiment in detail:

As shown in FIG. 2, the filtering component 108 includes a first sub-component 114 disposed on a signal line layer 116 of the circuit board 104.

As shown in FIG. 3, the filtering component 108 further includes a second sub-component 115 disposed on the signal ground layer 105 of the circuit board 104.

In one embodiment, the first sub-component 114 is electrically connected to the signal ground layer 105 of the circuit board 104, and the second sub-component 115 is electrically connected to the radiating element 109.

In a particular embodiment, with reference to FIG. 2 to FIG. 4, a first metalized through hole 117 and a second metalized through hole 118 are disposed passing through the circuit board 104.

A distance between the first metalized through hole 117 and the power feeding balun 110 is less than a distance between the second metalized through hole 118 and the power feeding balun 110.

A first end of the second sub-component 115 is electrically connected to the second ground point 113 of the power feeding balun 110, a second end of the second sub-component 115 is electrically connected to a first end of the first sub-component 114 using the first metalized through hole 117, and a second end of the first sub-component 114 is electrically connected to the signal ground layer 105 using the second metalized through hole 118.

Figure 9:
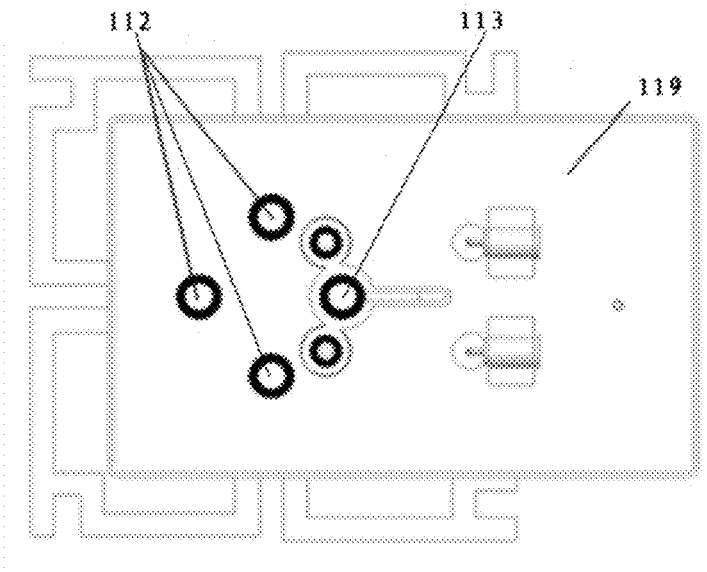
FIG. 9 is a schematic structural diagram of an embodiment of a signal ground layer of a multi-frequency communications antenna according to an embodiment of the present invention.

The following describes an optional setting manner of the signal ground layer 105 as an example:

Optionally, as shown in FIG. 9, the signal ground layer 105 of the circuit board 104 is a metal layer 119.

During a specific electrical connection, the first ground point 112 is electrically connected to the metal layer 119.

As shown in FIG. 9, instead of limiting, this embodiment describes an example in which a quantity of first ground points 112 is three.

The second ground point 113 is electrically connected to the first end of the filtering component 108, and the second end of the filtering component 108 is also electrically connected to the metal layer 119.

As shown in FIG. 9, instead of limiting, this embodiment describes an example in which a quantity of second ground points 113 is one.

Figure 10:
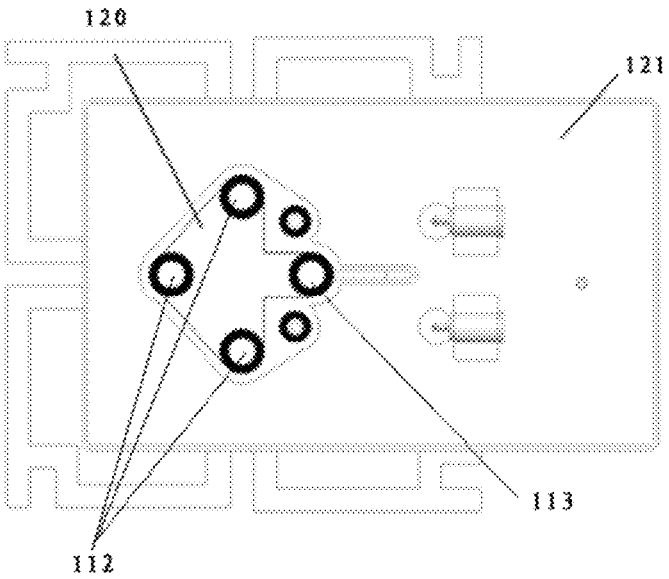
FIG. 10 is a schematic structural diagram of another embodiment of a signal ground layer of a multi-frequency communications antenna according to an embodiment of the present invention.

Optionally, as shown in FIG. 10, the signal ground layer 105 of the circuit board 104 includes a first metal layer 120 and a second metal layer 121 that are mutually insulated.

During a specific electrical connection, the high-frequency array 102 is electrically connected to the first metal layer 120, that is, the first ground point 112 is electrically connected to the first metal layer 120.

As shown in FIG. 10, instead of limiting, this embodiment describes an example in which a quantity of first ground points 112 is three.

The second ground point 113 is electrically connected to the first end of the filtering component 108, and the second end of the filtering component 108 is electrically connected to the second metal layer 121.

As shown in FIG. 10, instead of limiting, this embodiment describes an example in which a quantity of second ground points 113 is one.

Figure 11:
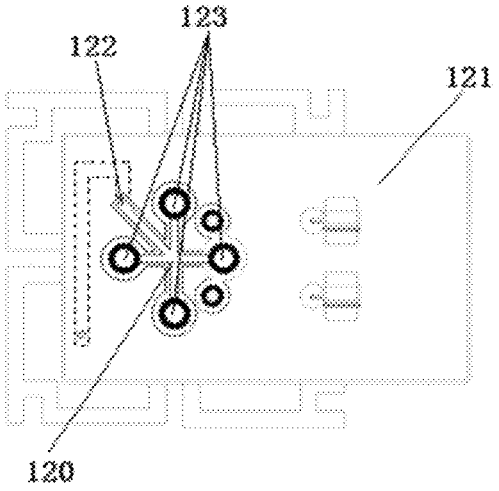
FIG. 11 is a schematic structural diagram of another embodiment of a signal ground layer of a multi-frequency communications antenna according to an embodiment of the present invention.

Optionally, as shown in FIG. 11, the signal ground layer 105 of the circuit board 104 includes a first metal layer 120 and a second metal layer 121 that are mutually insulated.

For this setting manner, at least one third ground point 123 is disposed on the second end of the power feeding balun 110.

As shown in FIG. 11, instead of limiting, this embodiment describes an example in which a quantity of third ground points 123 is four.

During a specific electrical connection, multiple third ground points 123 are connected to each other by means of the first metal layer 120, so that the multiple third ground points 123 are connected to a common node 122 by means of the first metal layer 120.

The common node 122 is electrically connected to the second metal layer 121, and the common node 122 is further electrically connected to the first end of the filtering component 108.

Figure 12:
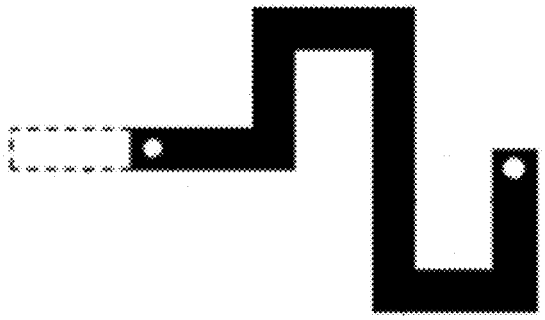
FIG. 12 is a schematic structural diagram of an embodiment of a first sub-component of a multi-frequency communications antenna according to an embodiment of the present invention.
Figure 13:
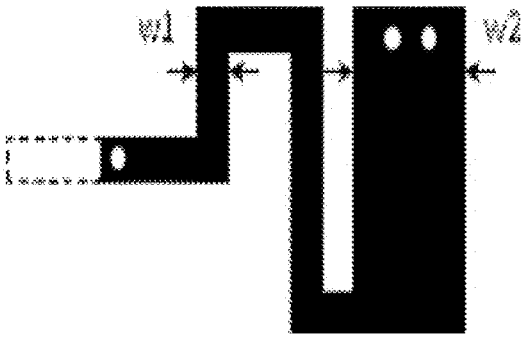
FIG. 13 is a schematic structural diagram of another embodiment of a first sub-component of a multi-frequency communications antenna according to an embodiment of the present invention.
Figure 14:
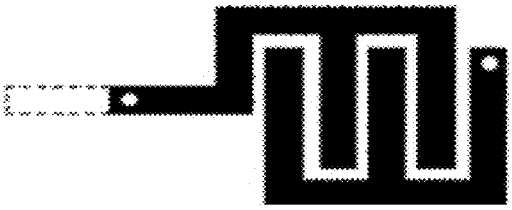
FIG. 14 is a schematic structural diagram of another embodiment of a first sub-component of a multi-frequency communications antenna according to an embodiment of the present invention.
Figure 15:
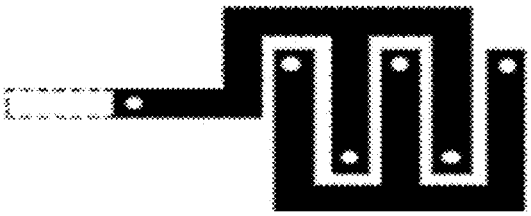
FIG. 15 is a schematic structural diagram of another embodiment of a first sub-component of a multi-frequency communications antenna according to an embodiment of the present invention.
Figure 16:
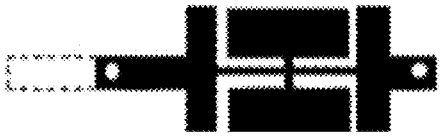
FIG. 16 is a schematic structural diagram of another embodiment of a first sub-component of a multi-frequency communications antenna according to an embodiment of the present invention.
Figure 17:
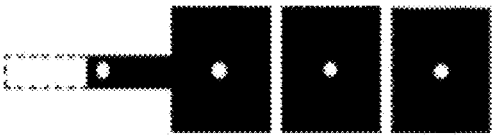
FIG. 17 is a schematic structural diagram of another embodiment of a first sub-component of a multi-frequency communications antenna according to an embodiment of the present invention.

The following describes a structure of the first sub-component 114 in detail with reference to the accompanying drawings:

Optionally, the structure of the first sub-component 114 may be an equal-width strip (as shown in FIG. 12), or the structure of the first sub-component 114 may be an unequal-width strip (as shown in FIG. 13), that is, as shown in FIG. 13, W1 is unequal to W2, or the structure of the first sub-component 114 may be an interdigital-coupling line (as shown in FIG. 14), or the structure of the first sub-component 114 may be a ground coupling line (as shown in FIG. 15), or the structure of the first sub-component 114 may be a compact microstrip resonant cell (as shown in FIG. 16), or the structure of the first sub-component 114 may be a mushroom-shaped grounding coupled diaphragm (as shown in FIG. 17).

Further, for a specific principle of the equal-width strip, the unequal-width strip, the interdigital-coupling line, the ground coupling line, the compact microstrip resonant cell, and the mushroom-shaped grounding coupled diaphragm described above, refer to the prior art, and details are not described in this embodiment.

An embodiment of the present invention further provides a base station. For details of a multi-frequency communications antenna included in the base station described in this embodiment, refer to the foregoing, and the details are not described in this embodiment.

It may be clearly understood by a person skilled in the art that, for the purpose of convenient and brief description, for a detailed working process of the foregoing system, apparatus, and unit, reference may be made to a corresponding process in the foregoing method embodiments, and details are not described herein again.

Finally, it should be noted that the above embodiments are merely provided for describing the technical solutions of the present invention, but not intended to limit the present invention. It should be understood by persons of ordinary skill in the art that although the present invention has been described in detail with reference to the embodiments, modifications can be made to the technical solutions described in the embodiments, or equivalent replacements can be made to some technical features in the technical solutions, as long as such modifications or replacements do not depart from the spirit and scope of the present invention.

What is claimed is:

1. A multi-frequency communications antenna, comprising:

at least one low-frequency array;

at least one high-frequency array;

at least one circuit board disposed corresponding to the high-frequency array, wherein the circuit board is configured to feed power to the high-frequency array;

a reflection panel to fasten the low-frequency array and the high-frequency array, wherein a side surface of the circuit board opposite to the reflection panel includes a signal ground layer, and the signal ground layer of the circuit board is coupled to the reflection panel; and a filtering component to decouple filtering is disposed on the circuit board, wherein a first end of the filtering component is electrically connected to the high-frequency array, and a second end of the filtering component is electrically connected to the signal ground layer of the circuit board.

2. The antenna according to claim 1, wherein the high-frequency array comprises a radiating element and a power feeding balun, wherein a first end of the power feeding balun is electrically connected to the radiating element, a second end of the power feeding balun is electrically connected to the signal ground layer of the circuit board, and the second end of the power feeding balun is further electrically connected to the first end of the filtering component.

3. The antenna according to claim 2, wherein at least one first ground point and at least one second ground point are disposed at the second end of the power feeding balun; and the first ground point and the second ground point are disposed passing through the circuit board, and the first ground point and the second ground point are soldered to the side surface of the circuit board opposite to the reflection panel, wherein the first ground point is electrically connected to the signal ground layer of the circuit board and the second ground point is electrically connected to the first end of the filtering component.

4. The antenna according to claim 3, wherein the filtering component comprises a first sub-component disposed on a signal line layer of the circuit board, and a second sub-component disposed on the signal ground layer of the circuit board, wherein the first sub-component is electrically connected to the signal ground layer of the circuit board, and the second sub-component is electrically connected to the radiating element.

5. The antenna according to claim 4, wherein a first metalized through hole and a second metalized through hole are disposed passing through the circuit board, and a distance between the first metalized through hole and the power feeding balun is less than a distance between the second metalized through hole and the power feeding balun; and a first end of the second sub-component is electrically connected to the second ground point of the power feeding balun, a second end of the second sub-component is electrically connected to a first end of the first sub-component using the first metalized through hole, and a second end of the first sub-component is electrically connected to the signal ground layer using the second metalized through hole.

6. The antenna according to claim 4, wherein a structure of the first sub-component comprises any one of the following:

an equal-width strip, an unequal-width strip, an interdigital-coupling line, a ground coupling line, a compact microstrip resonant cell, or a mushroom-shaped grounding coupled diaphragm.

7. The antenna according to claim 1, wherein the signal ground layer of the circuit board comprises at least one metal layer.

8. The antenna according to claim 7, wherein the signal ground layer of the circuit board comprises a first metal layer and a second metal layer that are mutually insulated; and the high-frequency array is electrically connected to the first metal layer, and the second end of the filtering component is electrically connected to the second metal layer.

9. The antenna according to claim 1, wherein a ratio of a center frequency of the high-frequency array to a center frequency of the low-frequency array is greater than or equal to 1.5 and less than or equal to 4.

10. Abase station, comprising:

a multi-frequency communications antenna, wherein the multi-frequency communications antenna comprises at least one low-frequency array, at least one high-frequency array, at least one circuit board disposed corresponding to the high-frequency array, wherein the circuit board is configured to feed power to the high-frequency array, a reflection panel to fasten the low-frequency array and the high-frequency array, wherein a side surface of the circuit board opposite to the reflection panel includes a signal ground layer, and the signal ground layer of the circuit board is coupled to the reflection panel; and a filtering component to decouple filtering is disposed on the circuit board, wherein a first end of the filtering component is electrically connected to the high-frequency array, and a second end of the filtering component is electrically connected to the signal ground layer of the circuit board.

11. The base station according to claim 10, wherein the high-frequency array comprises a radiating element and a power feeding balun, wherein a first end of the power feeding balun is electrically connected to the radiating element, a second end of the power feeding balun is electrically connected to the signal ground layer of the circuit board, and the second end of the power feeding balun is further electrically connected to the first end of the filtering component.

12. The base station according to claim 11, wherein at least one first ground point and at least one second ground point are disposed at the second end of the power feeding balun; and the first ground point and the second ground point are disposed passing through the circuit board, and the first ground point and the second ground point are soldered to the side surface of the circuit board opposite to the reflection panel, wherein the first ground point is electrically connected to the signal ground layer of the circuit board, and the second ground point is electrically connected to the first end of the filtering component.

13. The base station according to claim 12, wherein the filtering component comprises a first sub-component disposed on a signal line layer of the circuit board, and a second sub-component disposed on the signal ground layer of the circuit board, wherein the first sub-component is electrically connected to the signal ground layer of the circuit board, and the second sub-component is electrically connected to the radiating element.

14. The base station according to claim 13, wherein a first metalized through hole and a second metalized through hole are disposed passing through the circuit board, and a distance between the first metalized through hole and the power feeding balun is less than a distance between the second metalized through hole and the power feeding balun; and a first end of the second sub-component is electrically connected to the second ground point of the power feeding balun, a second end of the second sub-component is electrically connected to a first end of the first sub-component using the first metalized through hole, and a second end of the first sub-component is electrically connected to the signal ground layer using the second metalized through hole.

15. The base station according to claim 13, wherein a structure of the first sub-component comprises any one of the following:

an equal-width strip, an unequal-width strip, an interdigital-coupling line, a ground coupling line, a compact microstrip resonant cell, or a mushroom-shaped grounding coupled diaphragm.

16. The base station according to claim 10, wherein the signal ground layer of the circuit board comprises at least one metal layer.

17. The base station according to claim 16, wherein the signal ground layer of the circuit board comprises a first metal layer and a second metal layer that are mutually insulated; and wherein the high-frequency array is electrically connected to the first metal layer, and the second end of the filtering component is electrically connected to the second metal layer.

18. The multi-frequency communications antenna according to claim 10, wherein a ratio of a center frequency of the high-frequency array to a center frequency of the low-frequency array is greater than or equal to 1.5 and less than or equal to 4.

* * * * *